US007159993B1

(12) United States Patent
Lu

(10) Patent No.: US 7,159,993 B1
(45) Date of Patent: Jan. 9, 2007

(54) AUXILIARY LIGHT DEVICE FOR A KEY

(76) Inventor: Ta-Wei Lu, 3503 Ashlock Dr., Houston, TX (US) 77082

( * ) Notice: Subject to any disclaimer, the term of this patent is extended or adjusted under 35 U.S.C. 154(b) by 0 days.

(21) Appl. No.: 11/163,651

(22) Filed: Oct. 26, 2005

(51) Int. Cl.
*F21V 33/00* (2006.01)
*H01H 9/00* (2006.01)

(52) U.S. Cl. ..... 362/116; 200/52 R; 200/60; 200/310; 70/408; 70/456 R

(58) Field of Classification Search ..... 200/60, 200/52 R, 310; 70/278, 408, 277, 395, 456 R; 362/100, 109, 116, 500, 195, 201, 800, 191, 362/184, 802, 230, 231, 340, 234
See application file for complete search history.

(56) References Cited

U.S. PATENT DOCUMENTS 3,310,668 A * 3/1967 Schwartz ..... 362/116
4,085,315 A * 4/1978 Wolter et al. ..... 362/116
4,303,966 A * 12/1981 Wolter ..... 362/116
4,521,833 A * 6/1985 Wolter ..... 362/116
4,964,023 A * 10/1990 Nishizawa et al. ..... 362/100
5,181,927 A * 1/1993 Song ..... 362/116
5,515,248 A 5/1996 Canfield et al. ..... 362/116
6,132,058 A * 10/2000 Kuo ..... 362/116
6,164,795 A * 12/2000 Lopez ..... 362/116
6,182,484 B1 * 2/2001 Wolter ..... 70/395
6,224,228 B1 * 5/2001 Frederick ..... 362/116
6,626,019 B1 * 9/2003 Huang ..... 70/456 R
6,892,558 B1 * 5/2005 Chodosh ..... 70/456 R

* cited by examiner

*Primary Examiner*—Michael A. Friedhofer
(74) *Attorney, Agent, or Firm*—Alan D. Kamrath; Nikolai & Mersereau, P.A.

(57) ABSTRACT

An auxiliary light device for a key comprises a base, a lighting element, two batteries and a casing assembly. The base is to be fixed permanently on a gripping portion of a key, in the base are formed two battery chambers, in a front portion of the base is defined a notch facing the shaft of the key, the notch is connected to the battery chambers via a groove, in a rear portion of the base is formed a threaded hole. The lighting element is inserted in the notch of the base, two conductive terminals of the lighting element are engaged in the groove of the base and extended into the chambers. The two batteries are disposed in the chambers of the base and connected to the two conductive terminals, respectively. The casing assembly serves to cover the above-mentioned components and includes a cover, a button and a partition.

5 Claims, 5 Drawing Sheets

AUXILIARY LIGHT DEVICE FOR A KEY

BACKGROUND OF THE INVENTION

1. Field of the Invention

The present invention relates to an auxiliary light device for a key, and more particularly to a light device that can be detachably attached on the gripping portion of a key, and the consumption components of the light device can be replaced separately.

2. Description of the Prior Art

No matter at night or during the day, people always need to open door with a key, and opening a door, during the day time, is easy. However, at night, doing such a thing is not easy, people must need a torch to find the keyhole for insertion of the key, and then can insert the key in. Therefore, it is troublesome for a user to open the door with the key in one hand while holding the torch with another hand. To solve this problem, U.S. Pat. No. 5,515,248 discloses an adhesively attached key light device that is disposable and can be attached to the head of an ordinary key. However, the drawback of this conventional key light device is that it is environmental unfriendly and wasteful since the whole light device must be deserted when the battery runs out or when any one of the components of the light device is broken.

The present invention has arisen to mitigate and/or obviate the afore-described disadvantages.

SUMMARY OF THE INVENTION

The primary objective of the present invention is to provide a light device that can be detachably attached on the gripping portion of a key, and the consumption components of the light device can be replaced separately.

An auxiliary light device for a key in accordance with the present invention comprises a base, a lighting element, two batteries and a casing assembly; wherein:

the base is a block whose base is to be fixed permanently on a gripping portion of a key, in a center-left and a center-right portions of the base is formed a battery chamber, respectively, in a front portion of the base is defined a notch facing the shaft of the key, the notch is connected to the battery chambers via a groove, in a rear portion of the base is formed a threaded hole;

the lighting element has a bulb inserted in the notch of the base, two conductive terminals of the lighting element are engaged in the groove of the base 1 and extended into the chambers;

the two batteries are disposed in the chambers of the base and connected to the two conductive terminals, respectively, in such a manner that a positive electrode of one battery faces downward and a negative electrode of another battery faces downward; and the casing assembly serves to cover the abovementioned components and includes a cover, a button and a partition.

The base is permanently glued to the gripping portion of a key, and detachable casing assembly allows for easy replacement of the consumption material, so that the service life of the key light device is prolonged, furthermore, it is environmental friendly.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
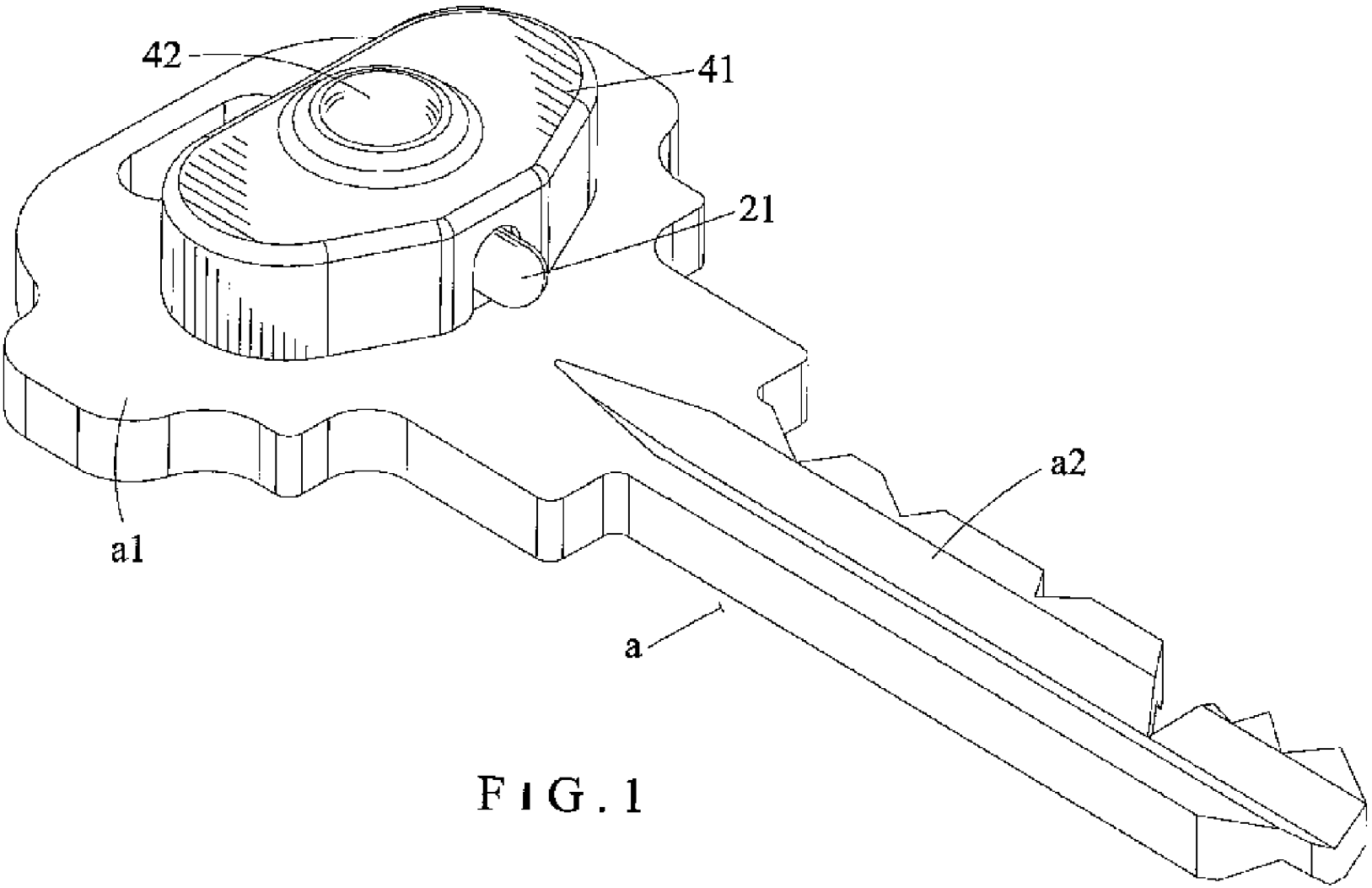
FIG. 1 shows a key with an auxiliary light device for a key in accordance with the present invention.
Figure 2:
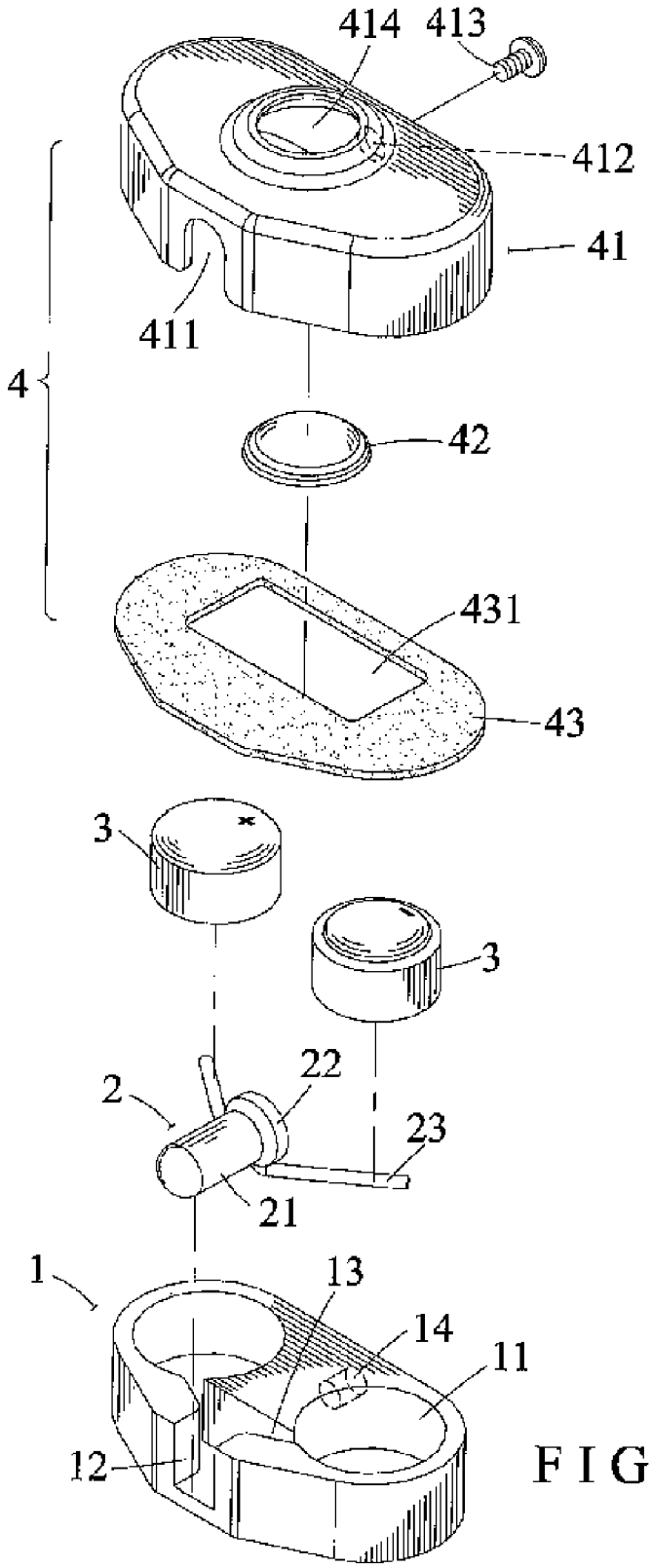
FIG. 2 is an exploded view of the auxiliary light device for a key in accordance with the present invention.
Figure 3:
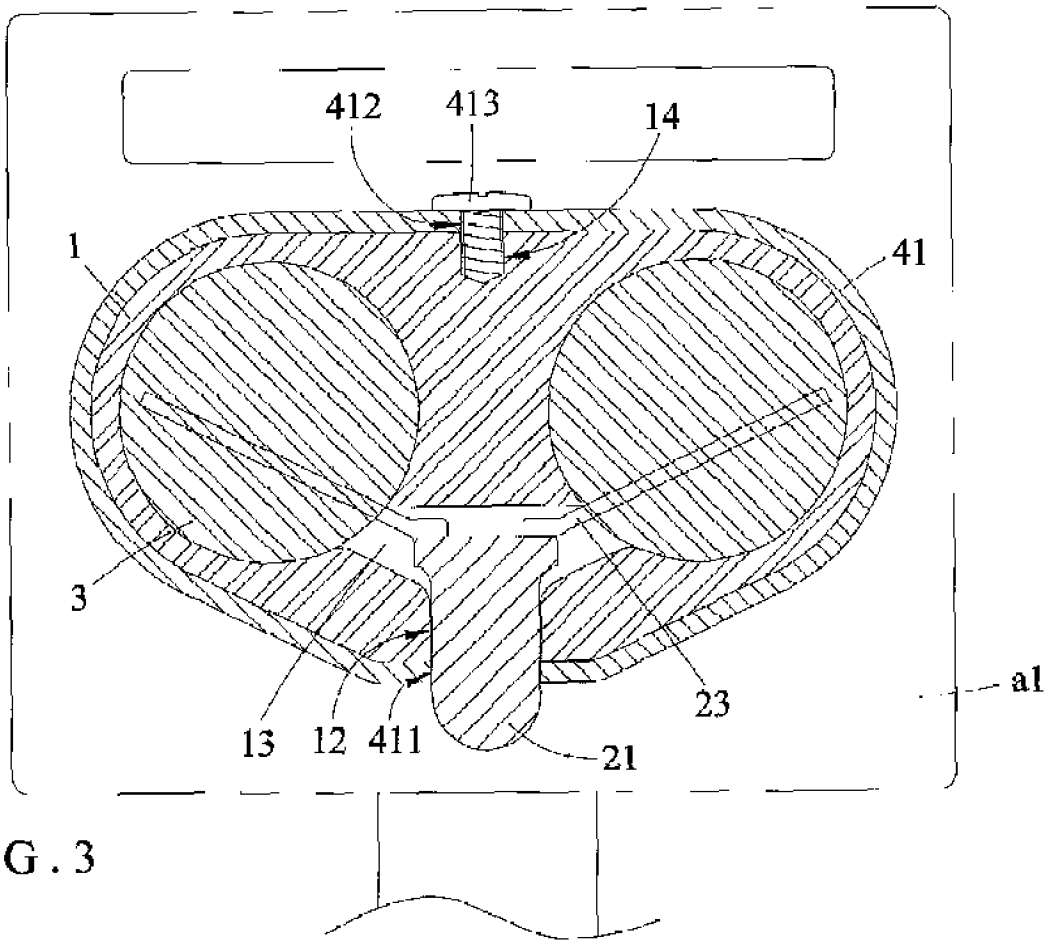
FIG. 3 is a transverse cross sectional view of the auxiliary light device for a key in accordance with the present invention.

Referring to FIGS. 1, 2 and 3, an auxiliary light device for a key in accordance with the present invention is shown and comprises a base 1, a lighting element 2, two batteries 3 and a casing assembly 4.

The base 1 is a block whose base can be fixed permanently on the gripping portion a1 of a key a, in a center-left and a center-right portions of the base 1 is formed a battery chamber 11, respectively. And in a front portion of the base 1 is defined a notch 12 facing the shaft a2 of the key a, and the notch 12 is connected to the battery chambers 11 via a groove 13. In a rear portion of the base 1 is formed a threaded hole 14.

The lighting element 2 can be a mini light emitting diode (LED), and the bulb 21 of the lighting element 2 is inserted in the notch 12 of the base 1 in such a manner that the bulb 21 partially protrudes out of the notch 12 and a flange 22 at the rear end of the bulb 21 abuts against the inner wall of the notch 12, thus preventing the disengagement of the lighting element 2 out of the notch 12. The lighting element 2 has two conductive terminals 23 to be engaged in the groove 13 of the base 1 and extended into the chambers 11.

The two batteries 3 are disposed in the chambers 11 of the base 1 and connected to the two conductive terminals 23, respectively, in such a manner that the positive electrode of one battery faces downward and the negative electrode of another battery faces downward.

The casing assembly 4 serves to cover the abovementioned components and includes a cover 41, a button 42 and a partition 43. The cover 41 is detachably mounted on the base 1 and is formed at the front sidewall thereof with a gap 411 to be aligned with the notch 12 of the base 1. In the rear sidewall of the cover 41 is formed a through hole 412 to be aligned with the threaded hole 14 of the base 1, so as to allow a screw 413 to be screwed in the threaded hole 14 via the through hole 412. In the top surface of the cover 41 is formed an aperture 414 located between the two batteries 3. The button 42 is a metal member to be installed in the cover 41 in a bottom-up fashion, the central protrusion of the button 42 partially protrudes out of the aperture 414 of the cover 41, and the button 42 is big enough to straddle the two batteries 3. The partition 43 is made of flexible isolation material, and the top surface of the partition 43 abuts against the inner top surface of the cover 41, so as to separate the button 42 from the batteries 3. In the partition 43 is formed an elongated rectangular hole 431 being located correspondingly to the batteries 3 and the button 42. The length of the rectangular hole 431 is larger than the diameter of the button 42, so that, when the button 42 is pressed, it can contact the two batteries 3. And the width of the rectangular hole 431 is less than the diameter of the button 42, so that, when the button 42 is not pressed, it can be kept staying above the partition 43 without touching the batteries 3.

Figure 4:
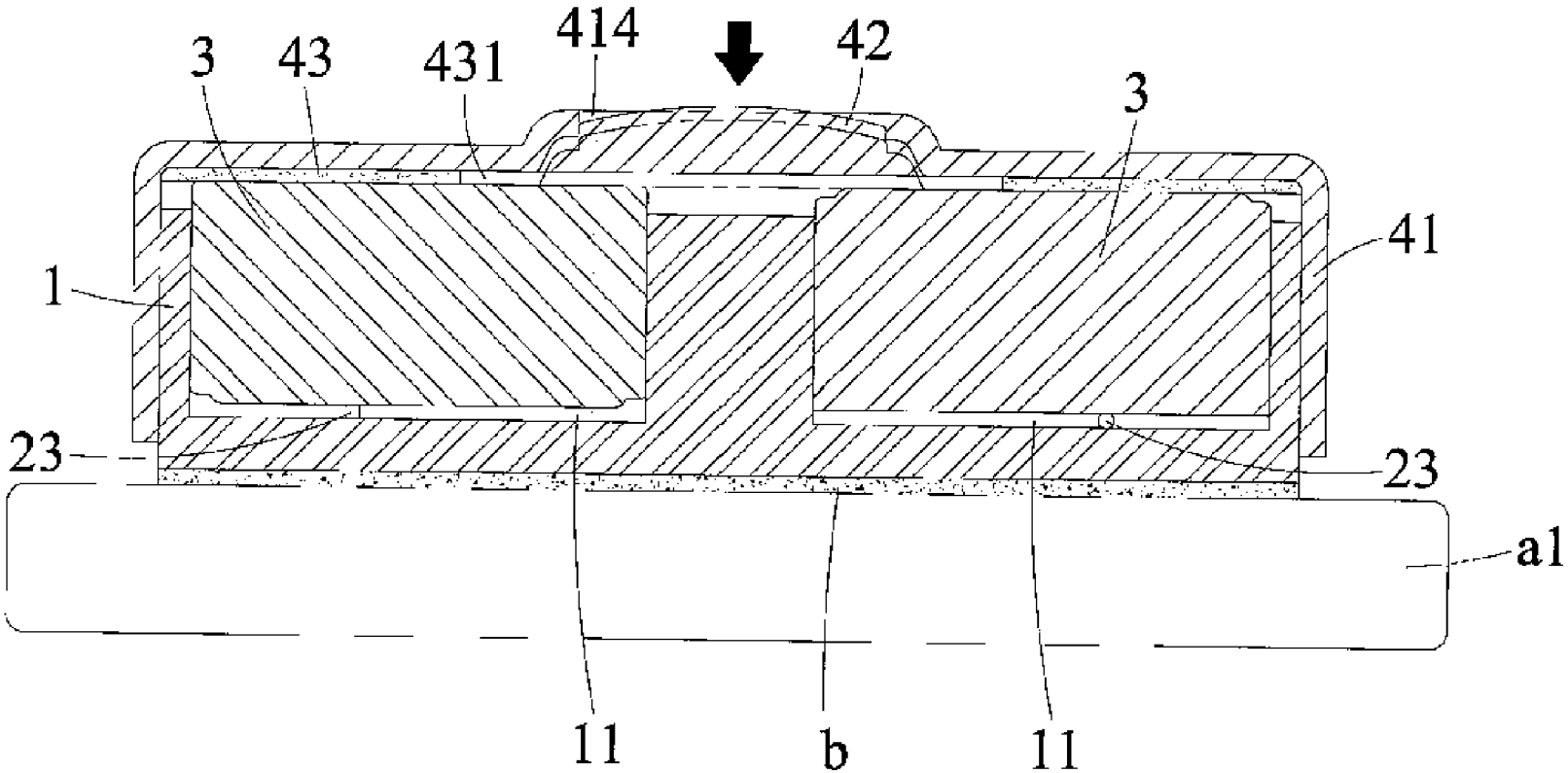
FIG. 4 is a longitudinal cross sectional view of the auxiliary light device for a key in accordance with the present invention.
Figure 5:
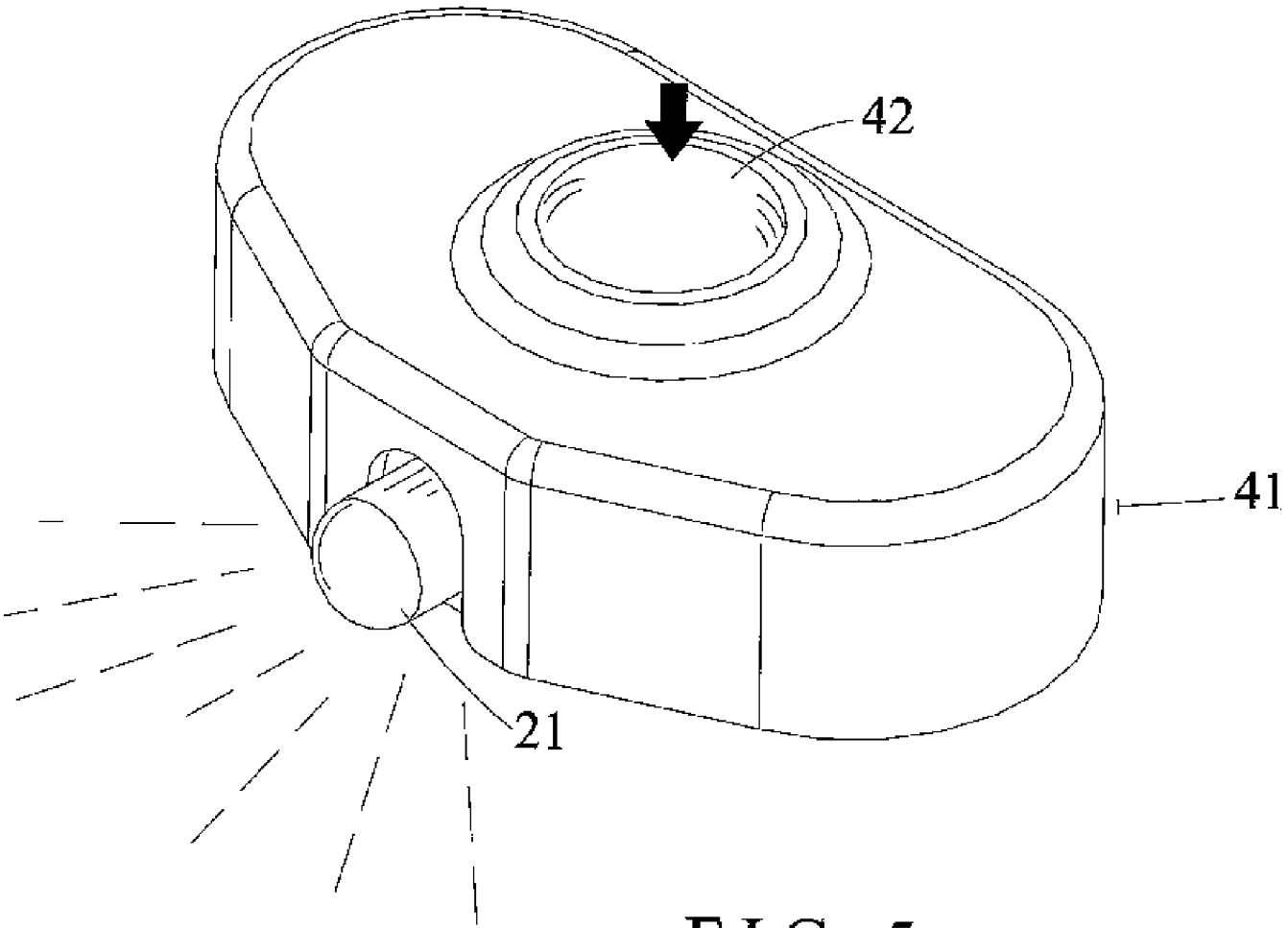
FIG. 5 is an assembly view of the auxiliary light device for a key in accordance with the present invention.

Referring to FIGS. 4 and 5, the light device for a key in accordance with the present invention is attached to the gripping portion a1 of the key a by adhesive b (that is coated on the bottom of the base 1), so that the base 1 is permanently fixed, and the bulb 21 of the lighting element 2 faces the shaft a2 of the key a. When the user presses the button 42, the partition 43 will be deformed, and the button 42 will ass the rectangular hole 431 and contact the two batteries 3, so that the lighting element 2 can be turned on to illuminate the position of the keyhole, guiding the insertion of the shaft a2. After the user releases the button 42, the partition 43 will restore its original shape and push the button 42 back to its original position, namely, the button 42 is kept from batteries 3, thus turning off the lighting element 2. When the batteries 3 run out or any component of the light device, the lighting element 2 for example, is broken, the user can remove the cover 41 away from the base 1 by unscrewing the screw 413 of the casing assembly 4, and thus the batteries 3 or the lighting element 2 can be replaced. Finally, the cover 41 can be reinstalled on the base 1 by screwing the screw 413.

The present invention has the following advantages:

1, the detachable casing assembly allows for easy replacement of the consumption material, so that the service life of the key light device is prolonged, furthermore, it is environmental friendly.

2, the key light device of the present invention is simple structured, thus it can save the production cost.

3, the key light device of the present invention is small and light, and can be fitted on various existing keys.

4. besides being used on a key, the light device in accordance with the present invention also can be attached to other objects for the purpose of illumination.

While we have shown and described various embodiments in accordance with the present invention, it should be clear to those skilled in the art that further embodiments may be made without departing from the scope of the present invention.

What is claimed is:

1. An auxiliary light device for a key comprising a base, a lighting element, two batteries and a casing assembly; wherein:

the base is a block whose base is to be fixed permanently on a gripping portion of a key, in a center-left and a center-right portions of the base is formed a battery chamber, respectively, in a front portion of the base is defined a notch facing a shaft of the key, the notch is connected to the battery chambers via a groove, in a rear portion of the base is formed a threaded hole;

the lighting element has a bulb inserted in the notch of the base, two conductive terminals of the lighting element are engaged in the groove of the base and extended into the chambers;

the two batteries are disposed in the chambers of the base and connected to the two conductive terminals, respectively, in such a manner that a positive electrode of one battery faces downward and a negative electrode of another battery faces downward; and the casing assembly serves to cover the abovementioned components and includes a cover, a button and a partition, the cover is detachably mounted on the base and is formed at a front sidewall thereof with a gap to be aligned with the notch of the base, in a rear sidewall of the cover is formed a through hole be aligned with the threaded hole of the base, so as to allow a screw to be screwed in the threaded hole via the through hole, in the top surface of the cover is formed an aperture located between the two batteries, the button is a metal member to be installed in the cover in a bottom-up fashion, the button is big enough to straddle the two batteries, the partition is made of flexible isolation material, and a top surface of the partition is attached to an inner top surface of the cover, and in the partition is formed a hole being located correspondingly to the batteries and the button.

2. The auxiliary light device for a key as claimed in claim 1, wherein the lighting element is a mini light emitting diode, and a flange at a rear end of the bulb abuts against an inner wall of the notch, thus preventing disengagement of the lighting element out of the notch.

3. The auxiliary light device for a key as claimed in claim 1, wherein a central protrusion of the button partially protrudes out of the aperture of the cover.

4. The auxiliary light device for a key as claimed in claim 1, wherein the partition serves to separate the button from the batteries.

5. The auxiliary light device for a key as claimed in claim 1, wherein the hole of the partition is an elongated rectangular hole, a length of the rectangular hole is larger than a diameter of the button, so that the button is pressed can contact the two batteries when it is pressed, and a width of the rectangular hole is less than the diameter of the button, so that, when the button is not pressed, the button will be kept staying above the partition without touching the batteries.

* * * * *